United States Patent [19]

Nykopp

[11] 4,216,056

[45] Aug. 5, 1980

[54] PAPER MACHINE HAVING A WATER EXTRACTION BOX EXTENSION

[75] Inventor: Erik A. Nykopp, Tampere, Finland

[73] Assignee: J. M. Voith GmbH, Heidenheim, Fed. Rep. of Germany

[21] Appl. No.: 14,495

[22] Filed: Feb. 23, 1979

[30] Foreign Application Priority Data

Feb. 24, 1978 [DE] Fed. Rep. of Germany ..... 2807894

[51] Int. Cl.[2] ..... D21F 1/36; D21F 1/52

[52] U.S. Cl. ..... 162/300; 162/317; 162/364

[58] Field of Search ..... 162/300, 301, 315, 317, 162/364, 203, 214, 217

[56] References Cited

U.S. PATENT DOCUMENTS

| | | | |
|---|---|---|---|
| 2,356,285 | 8/1944 | Street | 162/301 |
| 3,726,758 | 4/1973 | Parker et al. | 162/317 X |
| 3,891,500 | 6/1975 | Kankaanpaa | 162/315 X |
| 4,124,441 | 11/1978 | Nykopp | 162/301 |

FOREIGN PATENT DOCUMENTS

| | | |
|---|---|---|
| 1960884 | 3/1975 | Fed. Rep. of Germany . |
| 45780 | 10/1908 | Switzerland . |

*Primary Examiner*—Richard V. Fisher

*Attorney, Agent, or Firm*—Albert L. Jeffers; John F. Hoffman

[57] ABSTRACT

The invention relates to a paper machine of the kind having a continuous inner wire cloth and a continuous outer wire cloth which are passed together around a deflecting component, located within the inner wire cloth, for effecting extraction of water through the outer wire cloth, said machine also having a water extraction box located within the inner wire cloth in front of the deflecting component, and a breast (delivery) box, an upper lip of which lies adjacent the inner wire cloth in the vicinity of the water extraction box and defines, with a support surface provided by the water extraction box, a preliminary water extraction zone in which water can be extracted through the inner wire cloth into the water extraction box. The invention is characterized in that said upper lip of the breast box has a substantially rectilinear inner surface, and in that the deflecting component is a stationary part providing an extension of the water extraction box immediately after the preliminary water extraction zone in such a way that the fibrous web forming zone of the machine is extended up to the circumference of the deflecting component. An object of the invention is to provide a machine in which the fibrous web zone is arranged to provide improved fibrous webs and to be simple to manufacture.

20 Claims, 2 Drawing Figures

PAPER MACHINE HAVING A WATER EXTRACTION BOX EXTENSION

BACKGROUND OF THE INVENTION

The invention relates to a paper machine of the kind having a continuous inner wire cloth and a continuous outer wire cloth which are passed together around a deflecting component, located within the inner wire cloth, for effecting centrifugal extraction of water out of the outer wire cloth, said machine also having a water extraction box located within the inner wire cloth in front of the deflecting component, and a breast box, an upper lip of which lies adjacent the outer wire cloth in the vicinity of the water extraction box and defines, with a support surface provided by the water extraction box, a preliminary water extraction zone in which water can be extracted through the inner wire cloth into the water extraction box.

In a known paper machine of this kind, for example, U.S. Pat. No. 3,891,500, the inner wire cloth passes over a deflecting roller on a suction box, then over a free section without support and subsequently, together with an outer wire cloth, over a blowing roller on which water is spun out through the outer wire cloth. Above the suction box there is located the curved upper lip of a breast box, the lower lip of which terminates right at the beginning of the suction box. In this way, a preliminary water extraction zone is defined by the upper lip and the suction box. Further, it is known to extract water to either side within the fibrous web-forming zone, as shown in German Patent Specification No. 1,960,884.

SUMMARY OF THE INVENTION

According to the present invention a paper machine of the general type defined above is characterized in that the upper lip of the breast box has a substantially rectilinear inner surface, and in that the deflecting component is a stationary part providing an extension of the water extraction box immediately after the preliminary water extraction zone in such a way that the fibrous web forming zone is extended up to the circumference of the deflecting component.

It was recognized with the present invention that by using a rectilinear upper lip on the breast box instead of the curved lip used in the known paper machine, less strong disturbing currents in the fibrous suspension would arise during passage through the preliminary water extraction zone (Taylor's vortices effect) and, by arranging the deflecting component as an effective extension of the water extraction box immediately after the preliminary water extraction zone, continuous water extraction is possible without undesirable pulsating pressure fluctuations.

The two-zone water extraction obtainable within the web-forming zone in a paper machine according to the invention can result in the production of a fibrous web with a better tear strength in the z-direction (perpendicular to the plane of the web) and a better formed web. Furthermore, by using a stationary deflecting component instead of a rotating roller as in the case of U.S. Pat. No. 3,891,500, the deflecting component does not fling water back into the inner wire cloth and the fibrous web due to centrifugal force. Also, the wire cloth guiding surface on the glide component may have a considerably larger or smaller and better optimized curve radius than the known rollers or cylinders. With this combination of characteristics, a fibrous web of improved quality can be obtained. Energy savings may also be realized due to lower vacuum requirements in the water extraction box as compared to a rotating roll, to counteract centrifugal force tending to fling water back into web. The fibrous web is usually a paper web, but may, however, also be a plastic fiber web when plastic fibers are used.

Simplification and a reduction in costs in manufacturing the paper machine may also be achieved, due to the fact that simple stationary components are used and not rotating components as previously. According to a preferred embodiment of the invention, the water extraction box is a suction box. This enables a more rigorous water extraction to be achieved, at a controlled intensity.

The deflecting component can be provided with perforations in the area where the inner and outer wire cloths pass around it, so that water is extracted through the inner wire cloth in this area as well. In this case, it is advantageous if the deflecting component is also constructed as a suction box, since it is then possible to influence the water extraction process more strongly and individually.

According to a preferred feature of the invention the part of the water extraction box which carries the inner wire cloth can be substantially rectilinear in the section where it lies opposite to said upper lip of the breast box. This means that the inner wire cloth and also the upper lip lying opposite this both run in a straight line, so that with this design undesirable transverse currents or turbulence in the preliminary water extraction zone can be avoided in a particularly favorably way.

An expedient embodiment of the invention also consists in the water extraction box having a stationary lead-in part with a curved leading-in surface around which the inner wire cloth is passed. Compared with an equally possible roller, this has the advantage that the curve radius can be greater or smaller, as desired, than it can be for the roller. Large curve radii cannot be adopted readily in the known machines with deflecting rollers both in front of the water extraction box and behind it, since on one hand there is not always sufficient room available in the machine for rollers with such large diameters, and on the other hand these large rollers are expensive.

Naturally, in a paper machine according to the invention, the upper lip of the breast box may have variable length and may be height-adjustable, as in other known machines (see, for example, Swiss Patent Specification No. 45,780).

It is an object of the present invention to provide a paper machine in which the fibrous web that is produced is of improved quality.

A further object of the present invention is to provide a structure for the wet end of the machine whereby manufacturing costs of the machine can be reduced.

BRIEF DESCRIPTION OF THE DRAWINGS

Two embodiments of the invention will now be described by way of example with reference to the drawings, in which.

DETAILED DESCRIPTION

Figure 1:
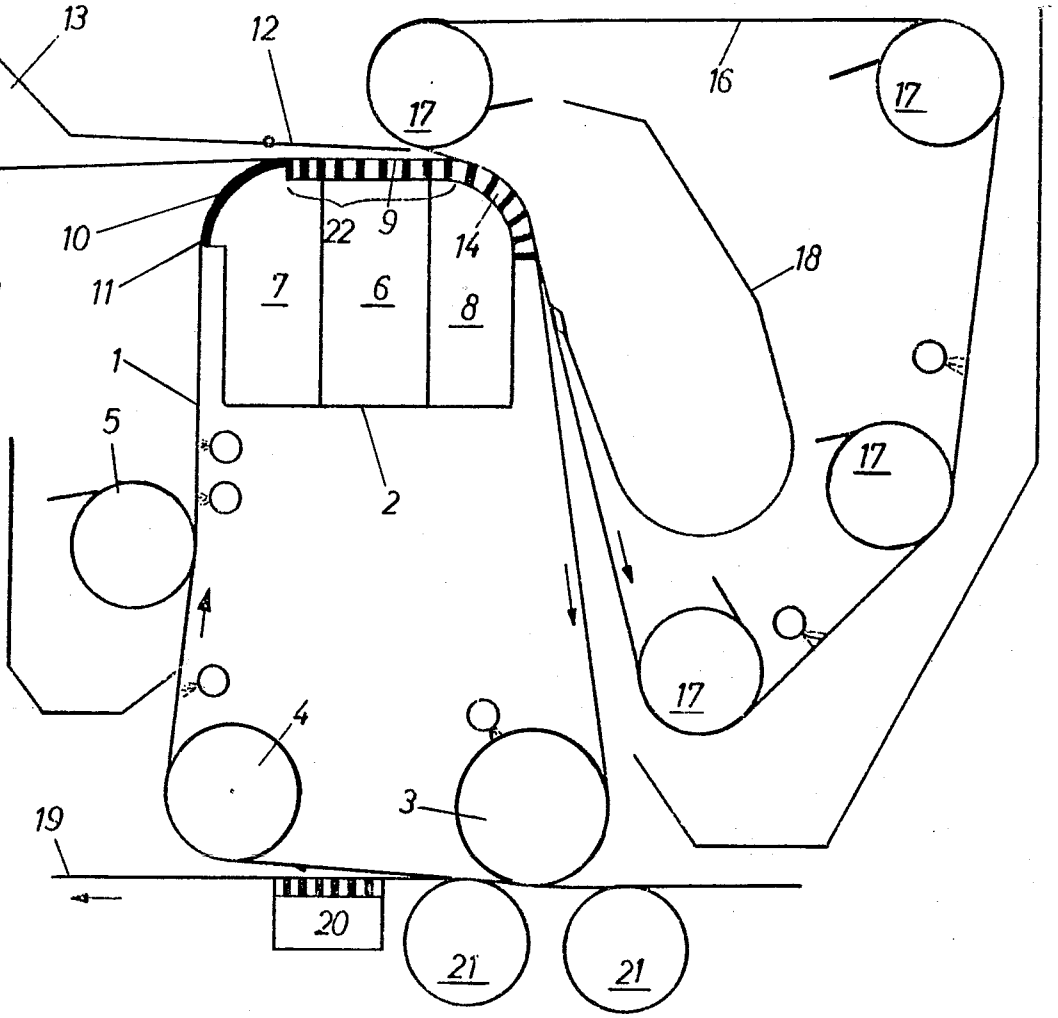
FIG. 1 is a diagrammatic view of the wet end of one embodiment of a paper machine according to the invention.

Referring to FIG. 1, a continuous inner wire cloth 1 passes over a water extraction box 2 and over deflecting guide rollers 3, 4 and 5. The water extraction box 2 is shown as having three suction box sections 6, 7 and 8 in which similar or different vacuum conditions may prevail. The support surface 9 of the intermediate suction box section 6 runs in a generally straight line, and is perforated. The surface part 10 of suction box section 7 is initially curved to provide the lead-in 11 for the inner wire cloth 1 to coincide with the surface part 9 of suction box section 6. The surface part 10 normaly perforated only in that area opposite which the upper lip 12 of a breast box 13 lies but could be perforated in other areas also. The surface part 14 of suction box section 8 is formed as a curved, perforated deflecting component for the inner wire cloth 1. The respective surface parts 9 to 11 of suction box sections 6 to 8 merge with each other to provide a smooth support surface for the inner wire cloth 1.

In the vicinity of the deflecting component 14 a continuous outer wire cloth 16 is guided to a position adjacent to the inner wire cloth 1 and the wire cloths are arranged to run together around the deflecting component 14. Deflecting rollers 17 serve to guide the outer wire cloth 16 further. A collecting trough 18 is located within the loop of the outer wire cloth 16 and is arranged so as to collect water which is spun off around the circumference of the deflecting component 14 and which passes through the outer wire cloth 16.

After running together around the deflecting component 14, the two wire cloths 1 and 26 separate. This separation could also be carried out later. In the constructional example shown, the fibrous web of paper running through the wet end of the machine remains at first on the inner wire cloth 1 and is then passed over into a carrier track 19, which may be in the form of a wire or a felt, a suction device 20 and rollers 21 being provided to effect the transfer of the fibrous web to said carrier track.

The reference numeral 22 generally designates a preliminary water extraction zone which is defined substantially by the upper lip 12 of the breast box 13, the surface part 10, the whole of surface part 9 and the initial surface part of the deflecting component 14. In this preliminary water extraction zone, water is extracted through the inner wire cloth 1 into sections 6, 7 and 8 of the water extraction box.

Thus, in a paper machine constructed as described above, due to the deflecting component 14 being provided as an extension of the water extraction box 2, i.e. immediately after the preliminary water extraction zone 22, the fibrous web forming zone of the machine is effectively extended up to the circumference of said deflecting component.

Figure 2:
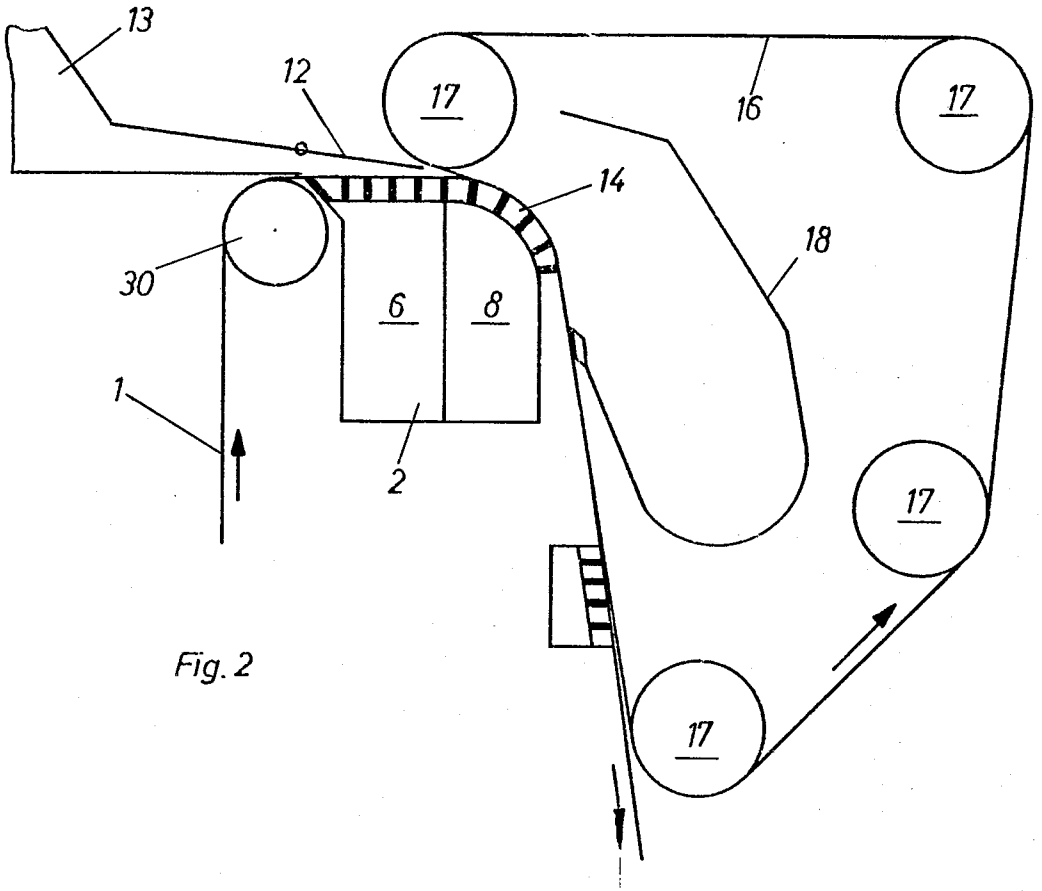
FIG. 2 is a view similar to FIG. 1 of a modified construction of the machine.

In the modified construction shown in FIG. 2, only two suction box sections 6 and 8 are provided, section 7 with the lead-in 11 (FIG. 1) being replaced by a deflecting roller 30. The stationary support surface provided by the surface parts of the suction box sections 6 and 8 is thereby reduced in length in order to reduce friction.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the part to which this invention pertains and fall within the limits of the appended claims.

What is claimed is:

1. In a paper machine having a continuous inner wire cloth loop and a continuous outer wire cloth loop which are passed together around a surface part of a deflecting component located within the inner wire cloth loop for effecting extraction of water through the outer and possibly inner wire cloths, a water extraction box located within the inner wire cloth loop in front of the deflecting component, relative to the direction of movement of the inner cloth, and having a support surface, and a breast box having an upper lip which lies adjacent the inner wire cloth in the vicinity of the water extraction box and defines, with said extraction box support surface, a fibrous web forming and preliminary water extraction zone into which water can be extracted through the inner wire cloth into the water extraction box, the improvement whereby the upper lip of said breast box has a substantially rectilinear inner surface, and in that said deflecting component is a stationary part providing an extension of said water extraction box immediately after the preliminary water extraction zone, relative to the direction of movement of said inner wire cloth.

2. A paper machine according to claim 1, characterized in that said water extraction box is a suction box.

3. A paper machine according to claim 1 or 2, characterized in that said deflecting component surface part is perforated in the area where said inner and outer wire cloths pass around it.

4. A paper machine according to claim 3, characterized in that said deflecting component is constructed as a suction box.

5. A paper machine according to claim 4 wherein: said inner wire cloth passes over said support surface of said water extraction box, and at least a portion of said support surface lies opposite said breast box upper lip, and said portion of said support surface is substantially rectilinear in the direction of movement of said inner wire cloth.

6. A paper machine according to claim 3 wherein: said inner wire cloth passes over said support surface of said water extraction box, and at least a portion of said support surface lies opposite said breast box upper lip and said portion of said support surface is substantially rectilinear in the direction of movement of said inner wire cloth.

7. A paper machine according to claim 1 or 2, wherein: said inner wire cloth passes over said support surface of said water extraction box, and at least a portion of said support surface lies opposite said breast box upper lip, and said portion of said support surface is substantially rectilinear in the direction of movement of said inner wire cloth.

8. The paper machine of claim 7 including a stationary lead-in with a curved lead-in surface part around which said inner wire cloth passes, said lead-in being before the preliminary water extraction zone, relative to the direction of movement of the inner wire cloth.

9. The paper machine of claim 7 including a roller located before said water extraction box, relative to the direction of movement of said inner wire cloth, around which said inner wire cloth passes.

10. The paper machine of claim 6 including a stationary lead-in with a curved lead-in surface part around which said inner wire cloth passes, said lead-in being before the preliminary water extraction zone, relative to the direction of movement of the inner wire cloth.

11. The paper machine of claim 6 including a roller located before said water extraction box, relative to the direction of movement of said inner wire cloth, around which said inner wire cloth passes.

12. The paper machine of claim 5 including a stationary lead-in with a curved lead-in surface part around which said inner wire cloth passes, said lead-in being before the preliminary water extraction zone, relative to the direction of movement of the inner wire cloth.

13. The paper machine of claim 5 including a roller located before said water extraction box, relative to the direction of movement of said inner wire cloth, around which said inner wire cloth passes.

14. The paper machine of claim 4 including a stationary lead-in with a curved lead-in surface part around which said inner wire cloth passes, said lead-in being before the preliminary water extraction zone, relative to the direction of movement of the inner wire cloth.

15. The paper machine of claim 4 including a roller located before said water extraction box, relative to the direction of movement of said inner wire cloth, around which said inner wire cloth passes.

16. The paper machine of claim 3 including a stationary lead-in with a curved lead-in surface part around which said inner wire cloth passes, said lead-in being before the preliminary water extraction zone, relative to the direction of movement of the inner wire cloth.

17. The paper machine of claim 3 including a roller located before said water extraction box, relative to the direction of movement of said inner wire cloth, around which said inner wire cloth passes.

18. The paper machine of claim 1 or 2, including a stationary lead-in with a curved lead-in surface part around which said inner wire cloth passes, said lead-in being before the preliminary water extraction zone, relative to the direction of movement of the inner wire cloth.

19. The paper machine of claim 1 or 2, including a roller located before said water extraction box, relative to the direction of movement of said inner wire cloth, around which said inner wire cloth passes.

20. A paper machine according to claim 1 wherein the fibrous web forming zone of the machine is extended up to the circumference of said deflecting component.

* * * * *